United States Patent [19]

Antal

[11] 4,332,670

[45] Jun. 1, 1982

[54] CATALYTIC DEWAXING OF MIDDLE DISTILLATES

[75] Inventor: Michael J. Antal, Lawrenceville, N.J.

[73] Assignee: Mobil Oil Corporation, New York, N.Y.

[21] Appl. No.: 224,971

[22] Filed: Jan. 14, 1981

[51] Int. Cl.[3] ..... C10G 45/58; C10G 69/04

[52] U.S. Cl. ..... 208/68; 208/85; 208/120; 208/351

[58] Field of Search ..... 208/68, 77, 85, 358

[56] References Cited

U.S. PATENT DOCUMENTS

| | | | |
|---|---|---|---|
| 3,700,585 | 10/1972 | Chen et al. | 208/111 |
| 3,891,540 | 6/1975 | Demmel et al. | 208/77 |
| 3,894,938 | 7/1975 | Gorring et al. | 208/97 |
| 4,235,706 | 11/1980 | Bannon | 208/358 X |

*Primary Examiner*—Delbert E. Gantz
*Assistant Examiner*—G. E. Schmitkons
*Attorney, Agent, or Firm*—Charles A. Huggett; Michael G. Gilman; Charles J. Speciale

[57] ABSTRACT

The fractionation and stripping equipment of a middle distillate catalytic dewaxing unit may be eliminated by integrating the catalytic dewaxing unit with a catalytic cracking unit. The light cycle oil sidestream from the cat cracker fractionator, bypasses the sidestream stripper and serves as the feed to the catalytic dewaxing unit. The dewaxed product is separated into a gasoline fraction which is recycled for fractionation in the cat cracker fractionator and a fuel oil fraction which is recycled to the cat cracker sidestream stripper for removal of light materials to produce a low pour fuel oil meeting product specifications.

12 Claims, 1 Drawing Figure

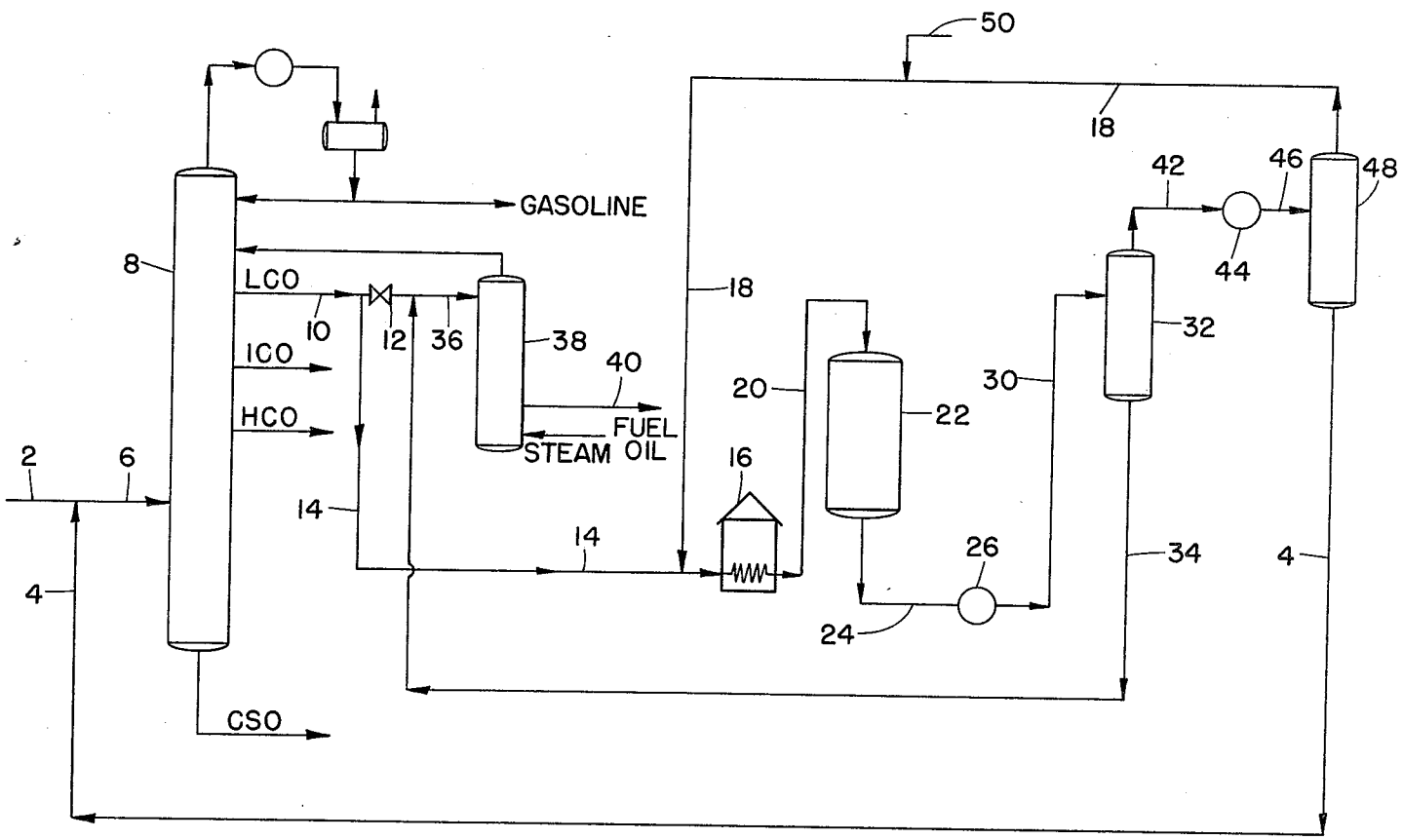
GASOLINE
FUEL OIL
STEAM
LCO
ICO
HCO
CSO
2
4
6
8
10
12
14
16
18
20
22
24
26
30
32
34
36
38
40
42
44
46
48
50

CATALYTIC DEWAXING OF MIDDLE DISTILLATES

BACKGROUND OF THE INVENTION

1. Field of the Invention

This invention relates to a hydrocarbon conversion process for reducing the pour point of a distillate having a boiling range above about 320° F. More particularly, it relates to a process for reducing the pour point of a catalytically cracked light cycle oil. This invention especially relates to the catalytic hydrodewaxing of a catalytically cracked light cycle oil.

2. Description of the Prior Art

Middle distillates obtained from crude oil, such as gas oils, have been processed heretofore to produce fuel oil products, including home heating oil, diesel fuel, furnace oil and the like. Specifications for these products normally include a requirement that the pour point may not exceed a certain maximum value. In some instances it is necessary to subject these distillate fuels to additional processing whose principal purpose is to reduce the pour point of the feedstream.

One such process, developed heretofore, is referred to as catalytic hydrodewaxing in which gas oil is contacted with hydrogen and a shape selective catalyst adapted to selectively crack or hydrocrack the paraffinic molecules in the gas oil. Initially the catalysts used were those zeolite cracking catalysts which had pore openings sized so that they would admit and crack only normal paraffins and exclude all other gas oil components, e.g. erionite type zeolite. U.S. Pat. No. Re. 28,398 of Chen et al. discloses an improvement to this process through substituting ZSM-5 type of zeolite for the previously used erionite type cracking catalyst. Using this type catalyst permitted more efficient operation. In addition to the normal paraffins, paraffins with slight branching e.g. with a methyl side group, were also cracked whereby dewaxing was carried out to a greater extent. This permitted lowering of the gas oil pour point in a very efficient manner. The product of hydrodewaxing gas oil may be suitably fractionated to produce high yields of dewaxed gas oil boiling in the same range as the feed, some naphtha and some light ($C_4-$) ends.

Catalytic dewaxing with a ZSM-5 type zeolite may be employed to improve the quality of a variety of feedstocks. In addition to gas oil, Chen et al.'s reissue patent discloses other useful feedstocks including crude oil, full range dehydrated shale oil and lube oil stock. U.S. Pat. Nos. 3,893,906 and 3,894,939 of Garwood et al. disclose that a mixture of gas oil and aromatic naphtha will yield a low pour point gas oil and a higher octane gasoline when subjected to this catalytic hydrodewaxing while U.S. Pat. No. 3,989,617 of Yan discloses an improvement process for catalytically treating lubricating oil base stocks with ZSM-5 type zeolites. Other improvements in this process when used alone or in combination with other processes are disclosed in U.S. Pat. Nos. 3,755,145 of Orkin, 3,852,189 of Chen et al., 3,894,938 of Gorring et al. and 3,956,102 of Chen et al.

One particularly effective combination process of catalytic cracking and catalytic hydrowaxing is disclosed in U.S. Pat. No. 3,891,540 of Demmel et al. This process is concerned with producing a light fuel oil with a low pour point. The catalytic cracking employs relatively mild conversion conditions, i.e. 45 volume percent, of fresh gas oil and heavy cycle oil in one riser and intermediate cycle oil in the second riser. The light cycle oil recovered from the catalytic cracking fractionator is subjected to catalytic hydrodewaxing with a ZSM-5 type crystalline zeolite. The effluent from the hydrodewaxing reactor is condensed, the hydrogen recovered for recycle and the condensed light sent to the hydrodewaxing unit fractionator. Here the desired low pour point fuel oil is recovered as the bottoms with the tower overhead of about 400° F. minus hydrocarbons comprising $C_4$ and lighter gaseous products plus hydrocarbons in the gasoline boiling range. The combination process of Demmel et al is practiced in two complete processing units, a catalytic cracker with all its usual attendant equipment, including a fractionator and a catalytic hydrodewaxer with its usual attendant equipment, including a fractionator. Thus, these units may be operated in combination or separately in a blocked-out operation.

It is an object of this invention to provide a process for reducing the pour point of catalytically cracked light cycle oil.

It is another object of this invention to provide a process for reducing the pour point of catalytic cracked light cycle oil which is integrated with the operation of the catalytic cracking unit.

It is a further object of this invention to provide a hydrodewaxing process integrated with a catalytic cracking process so as to perform the combined processes in a simpler fashion or by a reduced number of steps than is required for the individual processes.

SUMMARY OF THE INVENTION

The objects of this invention are fulfilled by the present invention, in accordance with which it has been found that a middle distillate can be subjected to a combination of catalytic cracking and catalytic dewaxing to produce a middle distillate with a significantly lower pour point without requiring the separate fractionating and stripping operations provided heretofore in both the catalytic cracking and catalytic dewaxing processes. More particularly, this improved method may be described as eliminating the fractionator and sidestream stripper from the catalytic dewaxing unit and performing whatever fractionating and stripping of the dewaxed effluent that is required in the fractionator and stripper of the catalytic cracking unit.

This invention is directed to an improvement in a process for reducing the pour point of a middle distillate boiling in the range of about 320° to about 800° F. of the type wherein the middle distillate is catalytically cracked, fractionated and stripped in a catalytic cracking unit and then catalytically dewaxed, which comprises:

(a) recovering the middle distillate subsequent to its being catalytically cracked and fractionated but prior to its being stripped in the catalytic cracking unit, (b) contacting the middle distillate of step (a) with a ZSM-5 type crystalline zeolite under hydrodewaxing conditions to produce a hydrodewaxed middle distillate, (c) recovering a first liquid distillate boiling above about 320° F. from the hydrodewaxed middle distillate of step (b) leaving a first gaseous effluent, (d) recovering a second liquid distillate boiling in the gasoline boiling range from the first gaseous effluent leaving a second gaseous effluent comprising hydrogen and light gaseous hydrocarbons.

(e) fractionating the second liquid distillate in the fractionator of the catalytic cracking unit to yield a gasoline product, and (f) stripping the first liquid distillate in the middle distillate stripper of the catalytic cracking unit to yield a middle distillate product having a reduced pour point.

BRIEF DESCRIPTION OF THE DRAWING

The drawing is a schematic flowplan of an embodiment of the invention.

DESCRIPTION OF THE PREFERRED EMBODIMENTS

The present invention relates to a process for reducing the pour point of a middle distillate, particularly a middle distillate boiling in the range of about 320° to about 800° F. Briefly, this invention may be described as an improvement to the combination process of U.S. Pat. No. 3,891,540 of Demmel et al. wherein the catalytic cracking unit and the catalytic dewaxing unit utilize a common fractionator and middle distillate stripper while providing substantially the same dewaxed fuel oil product obtained in the process of Demmel et al. Describing this invention in accordance with the process of Demmel et al, the light cycle oil is recovered directly from the cat cracker fractionator upstream from the middle distillate stripper and directed to the catalytic dewaxer where it is processed in the reactor. The reactor effluent is passed to a high temperature separator where a middle distillate liquid stream is recovered and then to a low temperature separator where a gasoline liquid stream is recovered. The gasoline stream is recycled to the cat cracker where it is combined with the cat cracker reactor effluent serving as the feed to the fractionator for gasoline recovery in admixture with cat cracker gasoline. The middle distillate stream is recycled to the cat cracker middle distillate stripper where it is steam stripped to remove lighter materials to produce the desired low pour fuel oil.

By utilizing the improvements of this invention, a catalytic dewaxing function can be incorporated into a catalytic cracking unit at a substantially reduced investment and at a substantially reduced operating cost as compared to blocked-out operations of catalytic cracking and catalytic dewaxing. Whereas a self-contained and self-sufficient catalytic dewaxing unit would require its own product fractionator and stripper when practicing the present invention, the operations performed by such equipment can be performed by similar equipment in the catalytic cracking unit. This is achieved, for example, by not passing the light cycle oil sidestream, drawn off the cat cracker main fractionator, to the cat cracker stripper but rather sending it directly to the catalytic dewaxing unit as the feedstream thereto. It is necessary, however, to provide a high temperature separator and a low temperature separator in the dewaxing unit so that the effluent from the dewaxing reactor can be separated into two liquid products, a middle distillate stream and a naphtha or gasoline stream. The gasoline is recycled to the cat cracker fractionator where it is combined with the feedstream thereto for recovery with the cat cracker gasoline while the dewaxed middle distillate is sent to the cat cracker light cycle oil stripper for removal of light materials.

The improvements of this invention may be incorporated into an existing catalytic cracking unit to provide the combined processes of catalytic cracking and catatlytic dewaxing. Alternately, the process of this invention can be included in a grass roots design where it is desired to provide the combination of catalytic cracking and catalytic dewaxing at significantly reduced investment and operating costs as opposed to designing these same processes as blocked-out operations.

Catalytic dewaxing is more particularly described in U.S. Pat. No. Re. 28,398, the entire contents of which are incorporated herein by reference.

The combined process of catalytic cracking and catalytic dewaxing is more particularly described in U.S. Pat. No. 3,891,540, the entire contents of which are incorporated herein by reference. Embodiments of the present invention may be employed to provide improvements to the combination of processes described in this patent.

The usual feedstock employed in the process of this invention will be obtained when a virgin gas oil is serving as the feedstream to a catalytic cracking unit. Gas oil generally has an initial ASTM boiling point in the range of about 320° to about 400° F. and an end point of about 800° to above 1000° F. After catalytically cracking the gas oil, the fractionation of the reactor effluent yields a light cycle oil which serves as the feed to the catalytic dewaxing unit. The light cycle oil normally will have an initial boiling point in the range of about 320° to about 400° F. and an end point of up to about 800° F. For example, a Durban virgin gas oil having an initial boiling point of 520° F. and a 95% point of 960 can produce light cycle oil cuts in the 430/650, 430/690 and 430/720° F. ranges, all of which may be employed in practicing this invention.

Those skilled in the art will appreciate that where conditions permit, other feedstocks besides a catalytically cracked middle distillate may serve as the feed in the process of this invention. Thus, for example, virgin atmospheric or vacuum gas oil could be dewaxed in this improved process where adequate capacity existed in the cat cracker fractionator and cycle oil stripper. In another embodiment, rather than sending the dewaxed middle distillate to the cat cracker cycle oil stripper, it could be processed in the gas oil stripper of a crude oil distillation unit, or serve as part of the feed to a catalytic cracking unit or a catalytic hydrodesulfurization unit.

The nature of the catalytic cracking process with which the present invention may be practiced is not critical. Thus, such well known processes as fluid catalytic cracking employing bed cracking, riser cracking or combinations thereof as well as moving bed catalytic cracking, such as airlift thermofor catalytic cracking, may provide the middle distillate which serves as the feed in the process of this invention.

The catalysts useful in this invention as dewaxing catalysts are the members of a novel class of zeolites that has unusual properties. Although they have unusually low alumina contents, i.e. high silica to alumina ratios, they are very active in causing organic molecules to react even when the silica to alumina ratio exceeds 30. The activity is surprising since the alumina in the zeolite framework is believed responsible for catalytic activity. These catalysts retain their crystallinity for long periods even in the presence of steam at high temperature which induces irreversible collapse of the framework of other zeolites, e.g. of the X and A type. Furthermore, carbonaceous deposits, when formed, may be removed by burning at higher than usual temperatures to restore activity.

An important characteristic of the crystal structure of this class of zeolites is that it provides constrained access to, and egress from, the intracrystalline pores by virtue of having a bore dimension greater than about 5 Angstroms and pore windows of about a size such as would be provided by 10-membered rings of oxygen atoms. It is to be understood, of course, that these rings are those formed by the regular disposition of the tetrahedra making up the anionic framework of the crystalline aluminosilicate, the oxygen atoms themselves being bonded to the silicon or aluminum atoms at the centers of the tetrahedra. Briefly, the preferred type catalyst useful in this invention posess, in combination: a silica to alumina ratio of at least about 12; and a structure providing constrained access to the crystalline free space.

The silica to alumina ratio referred to may be determined by conventional analysis. This ratio is meant to represent, as closely as possible, the ratio in the rigid anionic framework of the zeolite crystal and to exclude aluminum in the binder or in cationic form within the channels. Although catalysts with a silica to alumina ratio of at least 12 are useful, it is preferred to use catalysts having higher ratios of at least about 30. Such catalysts, after activation, acquire an intracrystalline sorption capacity for normal hexane which is greater than that for water, i.e. they exhibit "hydrophobic" properties.

The type zeolites useful in this invention freely sorb normal hexane and have a pore dimension greater than about 5 Angstroms. In addition, the structure must provide constrained access to larger molecules such as are present in middle distillates. It is sometimes possible to judge from a known crystal structure whether such constrained access exists. For example, if the only pore windows in a crystal are formed by eight membered rings of oxygen atoms, then access to molecules of larger cross-section than normal hexane is excluded and the zeolite is not of the desired type. Windows of ten-membered rings are preferred, although excessive puckering or pore blockage may render these catalysts ineffective. Twelve-membered rings do not generally appear to offer sufficient constraint to produce the subtle changes leading to significantly lower pour points although structure can be conceived, due to pore blockage or other cause, that may be operative.

Rather than attempt to judge from crystal structure whether or not a catalyst posesses the necessary constrained access, a simple determination of the "constraint index" can be made by passing continuously a mixture of equal weight of normal hexane and 3-methylpentane over a small sample, approximately 1 gram or less, of catalyst at atmospheric pressure according to the following procedure. A sample of the catalyst, in the form of pellets or extrudate, is crushed to a particle size about that of coarse sand and mounted in a glass tube. Prior to testing, the catalyst is treated with a stream of air at 100° F. for at least 15 minutes. The catalyst is then flushed with helium and the temperature adjusted between 550° F. and 950° F. to give an overall conversion between 10% and 60%. The mixture of hydrocarbons is passed at 1 liquid hourly space velocity (i.e. 1 volume of hydrocarbon per volume of catalyst per hour) over the catalyst with a helium dilution to give a helium to total hydrocarbon mole ratio of 4:1. After 20 minutes on stream, a sample of the effluent is taken and analyzed, most conveniently by gas chromatography, to determine the fraction remaining unchanged for each of the two hydrocarbons.

The constraint index is calculated as follows:

$$\text{Constraint Index} = \frac{\log_{10}(\text{fraction of n-hexane remaining})}{\log_{10}(\text{fraction of 3-methylpentane remaining})}$$

The constraint index approximates the ratio of the cracking rate constants for the two hydrocarbons. Catalysts suitable for the present invention are those having a constraint index from 1.0 to 12.0, preferably 2.0 to 7.0.

The class of zeolites defined herein is exemplified by ZSM-5, ZSM-11, ZSM-12, ZSM-21, TEA mordenite and other similar materials. U.S. Pat. No. 3,702,886 describing and claiming ZSM-5 is incorporated herein by reference.

ZSM-11 is more particularly described in U.S. Pat. No. 3,709,979, the entire contents of which are incorporated herein by reference.

ZSM-12 is more particularly described in U.S. Pat. No. 3,832,449, the entire contents of which are incorporated herein by reference.

ZSM-21 is more particularly described in U.S. application, Ser. No. 358,192, filed May 7, 1973, now abandoned, the entire contents of which are incorporated herein by reference.

TEA mordenite is more particularly described in U.S. application Ser. No. 130,442, filed Apr. 11, 1971, now abandoned, the entire contents of which are incorporated herein by reference.

The specific zeolites described, when prepared in the presence of organic cations, are catalytically inactive, possible because the intracrystalline free space is occupied by organic cations from the forming solution. They may be activated by heating in an inert atmosphere at 1000° F. for one hour, for example, followed by base exchange with ammonium salts followed by calcination at 1000° F. in air. The presence of organic cations in the forming solution may not be absolutely essential to the formation of this type zeolite; however, the presence of these cations does not appear to favor the formation of this special type of zeolite. More generally, it is desirable to activate this type catalyst by base exchange with ammonium salts followed by calcination in air at about 1000° f. for from about 15 minutes to about 24 hours.

Natural zeolites may sometimes be converted to this type zeolite catalysts by various activation procedures and other treatments such as base exchange, steaming, alumina extraction and calcination, in combinations. Natural minerals which may be so treated include ferrierite, brewsterite, stilbite, dachiardite, epistilbite, heulandite, and clinoptilolite. The preferred crystalline aluminosilicates are ZSM-5, ZSM-11, ZSM-12, ZSM-21, and TEA mordenite, with ZSM-5 particularly preferred.

The dewaxing catalysts of this invention may be in the hydrogen form which is the preferred form, or they may be base exchanged or impregnated to contain ammonium or a metal cation complement. It is desirable to calcine the catalyst after base exchange. The metal cations that may be present include any of the metals of Groups I through VII of the periodic table. However, in the case of Group IA metals, the cation content should in no case be so large as to effectively inactivate the catalyst. For example, a completely sodium exchanged H-ZSM-5 is not operative in the present invention.

In a preferred aspect of this invention, the dewaxing catalysts hereof are selected as those having a crystal density, in the dry of hydrogen form, of not substantially below about 1.6 grams per cubic centimeter. The preferred catalysts of this invention are those that satisfy three criteria, i.e. having a constraint index as defined above of about 1 to 12, a silica to alimina ratio of at least about 12 and a dried crystal density in the hydrogen form of not less than about 1.6 grams per cubic centimeter. The dry density for known structures may be calculated from the number of silicon plus aluminum atoms per 1000 cubic Angstroms, as given, e.g. on page 11 of the article on Zeolite Structure by W. M. Meier. This paper, the entire contents of which are incorporated herein by reference, is included in "Proceedings of the Conference on Molecular Sieves, London, April 1967," published by the Society of Chemical Industry, London, 1968. When the crystal structure is unknown, the crystal framework density may be determined by classical pyknometer techniques. For example, it may be determined by immersing the dry hydrogen form of the zeolite in an organic solvent which is not sorbed by the crystal. It is possible that the unusual sustained activity and stability of this class of zeolites is associated with its high crystal anionic framework density of not less than about 1.6 grams per cubic centimeter. This high density of course must be associated with a relatively small amount of free space within the crystal, which might be expected to result in more stable structures. This free space, however, is important as the locus of selective catalytic activity.

The zeolite catalyst can be used as such or in a matrix form, that is, incorporated in a matrix, suitably of alumina.

The catalyst can be used in a fixed, moving or fluidized bed as desired with the reaction zone appropriately designed therefor. The reaction zone may be operated in an upflow or downflow manner utilizing either trickle or flooded operation. The catalyst can be used as such or can be employed in a matrix as per the referred to patents and applications. It is preferred to provide a hydrogenation/dehydrogenation component, such as nickel or other metals having such known activity, in combination with the zeolite catalyst.

The amount of the hydrogenation/dehydrogenation component employed is not narrowly critical and can range from about 0.01 to about 30 weight percent based on the entire catalyst. A variety of hydrogenation components may be combined with the zeolite in any feasible manner which affords intimate contact of the components, employing well known techniques such as impregnation, coprecipitation, cogellation, mechanical admixture of one component with the other exchange and the like. The hydrogenation component can include metals of the Periodic Table which fall in Group VIB includng chromium, molybdenum, tungsten, and the like; Group IIB including zinc, cadmium; and Group VIII including cobalt, nickel, platinum, palladium, rhenium, rhodium and the like and combinations of metals of Group VIB and VIII, such as nickel-tungsten, cobalt-molybdenum and the like.

In this hydrodewaxing operation, conversion of the separated middle distillate product of the catalytic cracking operation is promoted by contact with a ZSM-5 type of crystalline aluminosilicate catalyst at a temperature maintained within the range of 500° to about 900° F., preferably within the range of 600° to about 800° F. at a pressure in the range of 100 to 800, preferably 200 to 600 psig and a liquid hourly space velocity within the range of 0.1 to 10.0, preferably 0.5 to 6.0 v/v/hr. It is preferred to conduct the pour point reduction operation in the presence of hydrogen in an amount sufficient to maintain a hydrogen to hydrocarbon mole ratio in the range of 2:1 to 10:1.

A preferred embodiment of this invention will be described with reference to the drawing. The gaseous effluent from a catalytic cracking reactor passes through line 2 where it is combined with a gasoline stream recycled through line 4 from a downstream recovery system, described hereinafter. The combined streams flow through line 6 and are introduced into cat cracker fractionating tower 8. In this fractionating tower the cracked gas oil is separated into an overhead of $C_4$ and lighter gases and gasoline, three sidestreams of light cycle oil (LCO), intermediate cycle oil (ICO) and heavy cycle oil (HCO) and a bottoms of clarified slurry oil (CSO). The sidestream of light cycle oil flows from fractionator 8 through line 10. Valve 12 is closed which directs the light cycle oil through line 14 to furnace 16 of the catalytic dewaxing unit where it is combined with hydrogen, recycled through line 18, from a downstream recovery system, described hereinafter. In furnace 16 the cycle oil is heated to a temperature of 500°–900° F. in the presence of hydrogen and then flows through line 20 to dewaxing reactor 22 where it contacts the dewaxing catalyst. Reactor 22 contains a bed of ZSM-5 type crystalline zeolite hydrodewaxing catalyst. Conditions within the reactor include a pressure of 100 to 800 psig and a LHSV of 0.1 to 10.0. During passage through the catalyst bed, the light cycle oil is dewaxed thereby reducing the pour point to the desired level. The hydrodewaxed cycle oil flows from reactor 22 through line 24 to cooler 26 where the temperature of the cycle oil is reduced to provide a liquid boiling above about 320° F. The partially condensed stream flows through line 30 into high temperature separator (HTS) 32 where the dewaxed liquid boiling in the fuel oil range (320°–800° F.) is recovered. This dewaxed fuel oil leaves HTS 32 through line 34 and is returned to the catalytic cracking unit where it flows through line 36 and into sidestream stripper 38 of the catalytic cracker fractionator. Steam is introduced into the bottom of stripper 38 to remove light materials from the dewaxed cycle oil so as to meet fuel oil specifications. The stripped and dewaxed product is removed from the stripper through line 40.

Returning to HTS 32 the gaseous products boiling below about 320°–400° F. leave separator 32 through line 42 and flow to cooler 44 where the temperature of the gaseous products is reduced to provide a liquid boiling in the gasoline boiling range. The partially condensed stream flows through line 46 and into low temperature separator (LTS) 48 where the gasoline is separated from the gases. The gasoline flows from LTS 48 through line 4 back to the cat cracker fractionator where it is combined with the cat cracker reactor effluent and introduced into fractionating tower 8 for recovery of the gasoline along with the gasoline obtained from the cat cracked gas oil. The gaseous stream, consisting of hydrogen and $C_4$ and lighter hydrocarbons, leaves LTS 48 through line 18 for hydrogen recovery (not shown) by well known means and is recycled to furnace 18 together with any required make-up hydrogen introduced through line 50.

What is claimed is:

1. In a process for reducing the pour point of a middle distillate boiling in the range of about 320° to about 800° F. of the type wherein the middle distillate is catalytically cracked, fractionated and stripped in a catalytic cracking unit and catalytically dewaxed, the improvement which comprises:

(a) recovering the middle distillate subsequent to its being catalytically cracked and fractionated but prior to its being stripped in the catalytic cracking unit, (b) contacting the middle distillate of step (a) with a ZSM-5 type crystalline zeolite under hydrodewaxing conditions to produce a hydrodewaxed middle distillate, (c) recovering a first liquid distillate boiling above about 320° F. from the hydrodewaxed middle distillate of step (b) leaving a first gaseous effluent, (d) recovering a second liquid distillate boiling in the gasoline boiling range from the first gaseous effluent leaving a second gaseous effluent comprising hydrogen and light gaseous hydrocarbons, (e) fractionating the second liquid distillate in the fractionator of the catalytic cracking unit to yield a gasoline product, and (f) stripping the first liquid distillate in the middle distillate stripper of the catalytic cracking unit to yield a middle distillate product having a reduced pour point.

2. A process according to claim 1 wherein the middle distillate of step (a) is a light cycle oil having a boiling range between about 400° and about 800° F.

3. A process according to claim 1 wherein step (c) is conducted by cooling the hydrodewaxed middle distillate to a temperature effective to form the first liquid distillate and separating the first liquid distillate from the first gaseous effluent.

4. A process according to claim 1 wherein step (d) is conducted by cooling the first gaseous effluent to a temperature effective to form the second liquid distillate and separating the second liquid distillate from the second gaseous effluent.

5. A process according to claim 1 wherein the stripping of step (f) is steam stripping.

6. A process according to claim 1 wherein the zeolite of step (b) is ZSM-5.

7. A process according to claim 1 wherein the zeolite of step (b) is ZSM-11.

8. A process according to claim 1 wherein the zeolite of step (b) is ZSM-21.

9. A process according to claim 1 wherein the catalytic cracking is fluid catalytic cracking.

10. A process according to claim 1 wherein the catalytic cracking is thermofor catalytic cracking.

11. A process according to claim 1 wherein the second gaseous effluent is recycled to step (b).

12. A process according to claim 1 wherein the hydrodewaxing conditions of step (b) include a temperature of about 500° to about 900° F., a pressure of about 400 to about 800 psig, a LHSV of about 0.1 to about 10.0 and a hydrogen to hydrocarbon mole ratio of about 2:1 to about 10:1.

* * * * *